US007014977B1

(12) United States Patent
Dickerson et al.

(10) Patent No.: US 7,014,977 B1
(45) **Date of Patent: *Mar. 21, 2006**

(54) REFLECTIVE RADIOGRAPHIC MATERIAL WITH INCORPORATED DEVELOPER

(75) Inventors: Robert E. Dickerson, Hamlin, NY (US); Kenneth A. Duke, Rochester, NY (US); Alan S. Fitterman, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/091,601

(22) Filed: Mar. 28, 2005

(51) Int. Cl.
*G03C 5/16* (2006.01)
*G03C 1/00* (2006.01)

(52) U.S. Cl. ..... 430/139; 430/350; 430/496; 430/567; 430/617; 430/618; 430/619; 430/620; 430/966; 430/967

(58) Field of Classification Search ..... 430/139, 430/350, 496, 567, 617–620, 966, 967
See application file for complete search history.

(56) References Cited

U.S. PATENT DOCUMENTS 6,630,291 B1 * 10/2003 Maskasky et al. ..... 430/350
6,770,428 B1 * 8/2004 Maskasky et al. ..... 430/619
2005/0100838 A1 * 5/2005 Dickerson et al. ..... 430/496
2005/0100840 A1 * 5/2005 Dickerson et al. ..... 430/496
2005/0100841 A1 * 5/2005 Dickerson et al. ..... 430/496

OTHER PUBLICATIONS

U.S. Appl. No. 11/091,609 (D-88390), filed herewith, titled *High Speed Reflective Radiographic Material*, by R.E. Dickerson et al.
U.S. Appl. No. 11/091,049 (D-88391, filed herewith, titled *Method of Processing Silver Halide Materialsl*, by A.S. Fitterman et al.

* cited by examiner

*Primary Examiner*—Geraldine Letscher
(74) *Attorney, Agent, or Firm*—J. Lanny Tucker

(57) ABSTRACT

A reflective radiographic material (at least 200 system speed) is useful especially to provide images that can be viewed without a light box. This reflective radiographic material has a reflective support, a silver halide emulsion on one side of the support only, and a photographic speed of at least 200. The reflective material also includes an incorporated black-and-white developing agent and a co-developing agent, and can be used with a single fluorescent intensifying screen as part of an imaging assembly. The reflective support enables viewing the resulting image without a light box and the high speed of the material enables the use of low power X-radiation generating equipment. The incorporated black-and-white developing agent and co-developing agent allow the radiographic material to be quickly processed after exposure using simplified processing chemistry.

20 Claims, No Drawings

REFLECTIVE RADIOGRAPHIC MATERIAL WITH INCORPORATED DEVELOPER

FIELD OF THE INVENTION

This invention is directed to radiography. In particular, it is directed to a high speed radiographic material that provides medical diagnostic images on a reflective support. This reflective radiographic material includes an incorporated developer.

BACKGROUND OF THE INVENTION

In conventional medical diagnostic imaging, the object is to obtain an image of a patient's internal anatomy with as little X-radiation exposure as possible. The fastest imaging speeds are realized by mounting a duplitized radiographic element between a pair of fluorescent intensifying screens for imagewise exposure. About 5% or less of the exposing X-radiation passing through the patient is adsorbed directly by the latent image forming silver halide emulsion layers within the duplitized radiographic element. Most of the X-radiation that participates in image formation is absorbed by phosphor particles within the fluorescent screens. This stimulates light emission that is more readily absorbed by the silver halide emulsion layers of the radiographic element.

Examples of radiographic element constructions for medical diagnostic purposes are provided by U.S. Pat. No. 4,425,425 (Abbott et al.), U.S. Pat. No. 4,425,426 (Abbott et al.), U.S. Pat. No. 4,414,310 (Dickerson), U.S. Pat. No. 4,803,150 (Dickerson et al.), U.S. Pat. No. 4,900,652 (Dickerson et al.), U.S. Pat. No. 5,252,442 (Tsaur et al.), and U.S. Pat. No. 5,576,156 (Dickerson), and *Research Disclosure*, Vol. 184, August 1979, Item 18431.

Radiographic films that are sensitive to blue light and have transparent supports are described in U.S. Pat. No. 6,686,115 (Dickerson et al.), U.S. Pat. No. 6,686,116 (Dickerson et al.), U.S. Pat. No. 6,686,117 (Dickerson et al.), U.S. Pat. No. 6,686,118 (Davis et al.), U.S. Pat. No. 6,686,119 (Pavlik et al.), and U.S. Pat. No. 6,682,868 (Dickerson et al.).

Problem to be Solved

The earliest radiographic elements typically comprised a silver halide emulsion coated on a single side of a glass substrate. More recently, radiographic elements or materials described and used in the art have traditionally contained various silver halide emulsion layers coated on a transparent film support (often coated on both sides) so the resulting images can be viewed using light boxes. However, in many remote parts of the world, light boxes are not available, thereby severely limiting the usefulness of traditional radiographic elements.

Chest radiography is one of the most common uses of radiographic imaging in the world. However, because of the nature of the organs in the chest cavity, imaging has been limited to using high-powered, fixed installation X-radiation generating equipment. Based on an American College of Radiology ("ACR") clinical practice standard, chest radiography should be performed at exposure times less than 40 milliseconds (less than 15 milliseconds for pediatric patients). This is necessary in order to stop the motion of the beating heart and adjacent blood vessels as well as to stop the motion of the surrounding lung tissues (respiration-induced motion and cardiac motion). While most patients can hold their breath for a brief time, the most critically ill patients cannot do so, further exacerbating this problem.

Additionally, a 10:1, 103 line/mm anti-scatter grid is recommended by the ACR in order to reduce scattered radiation, putting additional stress on the X-radiation exposure system. An unusually long X-radiation tube focus-film distance of 72 inches (178 cm) (40 inches or 102 cm for portable exams) is recommended in order to minimize X-radiation tube focal spot image blur. This long focus-film distance reduces the intensity of the X-radiation beam to about 25% of its normal intensity, further limiting the utility of low-powered X-radiation units. A radiographic system speed of 200 is recommended, based on existing commonly available screen/film/processing technology.

Given these standardized exposure conditions and radiographic technique considerations, inexpensive (low-powered) x-ray generators cannot produce clinically acceptable, motion-artifact-free chest radiographs using available screen-radiographic film systems that have unacceptably low system speed.

For imaging systems with substantially reduced image blur and high speed, experience has taught us that high system speed and high clinical image quality are not mutually exclusive.

In addition, for imaging systems with the primary advantage of very high speed, reducing or eliminating concerns about patient motion during radiographic exposures with low-powered X-radiation equipment will make clinically useful chest radiography a practical examination for the first time with such equipment. Currently, the only solution to this problem is to use full-powered X-radiation generators that are not affordable in most of the developing countries of the world.

In addition, in many parts of the world, there is insufficient electrical power to generate X-radiation using traditional imaging machines and such high power X-radiation generators are usually located in "fixed" installation and not portable into remote regions.

Thus, high-powered X-radiation generating equipment is not generally available in situations such as mobile military radiography, field veterinary medicine, on-site sports radiography, and some industrial/security radiography where portability and low electrical power requirements are essential. In these and other applications, very high speed screen-film materials are critical to the ability of the radiographic systems to make a properly exposed radiograph and stop patient motion by using short exposure times with limited X-radiation tube output.

Thus, there is a need to find a means to provide meaningful radiographic imaging and diagnostics without the need for a light box so the image can be viewed under ambient lighting. In addition, it would be useful to find a way to accurately and effectively image patients with minimal X-radiation exposure using low power X-radiation generators for radiographic uses including chest radiography.

SUMMARY OF THE INVENTION

This invention provides a reflective radiographic silver halide material having a speed of at least 200 and comprising a reflective support having first and second major surfaces, the radiographic silver halide material having on the first major surface only, one or more hydrophilic colloid layers including a silver halide emulsion layer comprising predominantly tabular silver halide grains, the tabular grains in said silver halide emulsion layer being dispersed in a hydrophilic polymeric vehicle mixture comprising at least 0.05% (weight) of oxidized gelatin, based on the total dry weight of the polymeric vehicle mixture, the material further comprising in at least one layer on the first major surface, a combination of an incorporated black-and-white developing agent and a co-developing agent.

The invention also provides a radiographic imaging assembly that has a system speed of at least 200 and comprises:

A) a radiographic material of this invention, and

B) a fluorescent intensifying screen arranged on the imaging side of the radiographic material, the screen having a screen speed of at least 100 and comprising an inorganic phosphor capable of absorbing X-radiation and emitting electromagnetic radiation having a wavelength greater than 300 nm, the inorganic phosphor being coated in admixture with a polymeric binder in a phosphor layer onto a support.

Further, this invention provides a method of providing a black-and-white image comprising processing an exposed reflective radiographic material of this invention to provide a black-and-white image. Exposure of the reflective radiographic material can be accomplished using a single fluorescent intensifying screen. The resulting black-and-white images in the processed reflective radiographic material can be used for a medical diagnosis.

In particular, the present invention provides a high-speed radiographic material that can be imaged using low-power X-radiation generating machines (that is, those using less than 130 kVp power source of X-radiation) and the resulting image can be viewed and used in ambient light (that is, without a light box). Such low-power imaging machines can be more readily used in remote parts of the world, mobile radiography, field veterinary medicine, at sporting events, or other sites where conventional high-power imaging machines are unavailable or inconvenient. These advantages are achieved by replacing the traditional transparent film supports of radiographic films with a "reflective" support. In addition, the silver halide emulsion(s) on a single side of this reflective support are designed to have high photographic speed so that lower radiation dosage can be used to provide useful images. The images can be obtained from the radiographic films using simple processing chemistry because the radiographic films include an "incorporated" black-and-white developing agent and co-developing agent.

DETAILED DESCRIPTION OF THE INVENTION

Definition of Terms

Unless otherwise indicated, the terms "radiographic imaging assembly", "imaging assembly", and "radiographic material", and "reflective radiographic material" refer to embodiments of the present invention.

The term "contrast" as herein employed refers to the average contrast derived from a characteristic curve of a radiographic film using as a first reference point (1) a density ($D_1$) of 0.25 above minimum density and as a second reference point (2) a density ($D_2$) of 2.0 above minimum density, where contrast is D (i.e. 1.75)÷$\Delta\log_{10}E$ ($\log_{10}E_2-\log_{10}E_1$), $E_1$ and $E_2$ being the exposure levels at the reference points (1) and (2).

"Gamma" is used to refer to the instantaneous rate of change of a density vs. logE sensitometric curve (or instantaneous contrast at any loge value).

"System speed" refers to a measurement given to combinations ("systems" or imaging assemblies) of radiographic silver halide material and fluorescent intensifying screen that is calculated using the conventional ISO 9236-1 standard wherein the radiographic material is exposed and processed under the conditions specified in Eastman Kodak Company's Service Bulletin 30. In general, system speed is thus defined as 1 milliGray/$K_S$ wherein $K_S$ is Air Kerma (in Grays) required to achieve a density=1.0+$D_{min}$+fog. In addition, 1 milliRoentgen (mR) is equal to 0.008732 milliGray (mGray). For example, by definition, if 0.1 milliGray (equal to 11.4 mR) incident on a film-screen system creates a density of 1.0 above $D_{min}$+fog, that material-screen system is considered to have a speed of "10".

However, it is common in the trade to use a "scaled" version of system speed, wherein commercially available KODAK Min-R 2000 radiographic film used in combination with a commercially available KODAK Min-R 2000 intensifying screen is assigned or designated a speed value of "150". Bunch et al. *SPIE Medical Imaging*, Vol. 3659 (1999), pp. 120–130 shows that it requires 6.3 mR for such a KODAK Min-R 2000 film/screen system to reach a density of 1.0 above $D_{min}$+fog. This gives an ISO speed value of 18.1 for this particular system. Thus, the relationship between the ISO speed value and the common definition of system speed is the ratio 150/18.1=8.25. That is, the numerical values of the common system speed values are 8.25 times those directly obtained using equation 7.1 of the noted ISO 9236-1 standard.

The "scaled" system speed values common in the trade are used in this application. However, they can be converted to ISO speed values by dividing them by 8.25.

In this application, "film speed" is in reference to the reflective radiographic material of this invention. Film speed has been given a standard of "150" for a commercially available KODAK Min-R 2000 radiographic film that has been exposed for 1 second and processed according to the Service Bulletin 30 using a fluorescent intensifying screen containing a terbium activated gadolinium oxysulfide phosphor (such as Screen X noted below in the Example). Thus, if the $K_S$ value for a given system using a given radiographic film is 50% of that for a second film with the same screen and exposure and processing conditions, the first film is considered to have a speed 200% greater than that of the second film. This commercially available film as also been described as Film A in U.S. Pat. No. 6,037,112 (Dickerson).

Also in this application, "screen speed" has been given a standard of "150" for a conventional KODAK Min-R 2000 screen containing a terbium activated gadolinium oxysulfide phosphor. Thus, if the $K_S$ value for a given system using a given screen with a given radiographic film is 50% of that for a second screen with the same film and exposure and processing conditions, the first screen is considered to have a speed 200% greater than that of the second screen. The KODAK Min-R 2000 fluorescent intensifying screen identified above contains a terbium activated gadolinium oxysulfide phosphor (median particle size of about 3.8 to 4.0 $\mu$m) and 10 ppm (based on total phosphor weight) of finely divided carbon (0.1 to 0.5 $\mu$m) dispersed in a Permuthane U6366™ polyurethane binder on a blue-tinted poly(ethylene terephthalate) film support having a thickness of about 180 $\mu$g/m. The total phosphor coverage is 3.3 g/dm$^2$ and the phosphor to binder weight ratio is 21:1. The dried thickness of the phosphor layer is about 84 $\mu$m phosphor to binder weight ratio is 21:1. The dried thickness of the phosphor layer is about 84 μm. Over the phosphor layer is disposed a protective overcoat layer comprising cellulose acetate and crosslinked polystyrene matte particles present at 3% of the weight of the total overcoat. The overcoat has been coated to a dry thickness of about 6 μm.

The term "dynamic range" refers to the difference between $D_{max}$ and $D_{min}$ values on the Density vs. logE sensitometric curve at a specified exposure time. In the case of the data presented below in the Examples, the specified exposure time was 1/50 of a second.

The term "duplitized" is used to define a radiographic material having one or more silver halide emulsion layers disposed on both the front- and backsides of the support. The reflective radiographic materials of the present invention are not "duplitized."

In referring to grains and silver halide emulsions containing two or more halides, the halides are named in order of ascending molar concentrations.

The term "equivalent circular diameter" (ECD) is used to define the diameter of a circle having the same projected area as a silver halide grain. This can be measured using known techniques described for example in U.S. Pat. No. 4,425,425 (Abbott et al.).

The term "aspect ratio" is used to define the ratio of grain ECD to grain thickness.

The term "coefficient of variation" (COV) is defined as 100 times the standard deviation (a) of grain ECD divided by the mean grain ECD.

The term "fluorescent intensifying screen" refers to a "prompt" emitting fluorescent intensifying screen that will emit light immediately upon exposure to radiation while a "storage" fluorescent screen or storage phosphor panel can "store" the exposing X-radiation for emission at a later time when the screen or panel is irradiated with other radiation (usually visible light).

The terms "front" and "back" refer to layers, films, or fluorescent intensifying screens nearer to and farther from, respectively, the source of X-radiation.

*Research Disclosure* is published by Kenneth Mason Publications, Ltd., Dudley House, 12 North St., Emsworth, Hampshire P010 7DQ England. The publication is also available from Emsworth Design Inc., 147 West 24th Street, New York, N.Y. 10011.

Reflective Radiographic Materials

The reflective radiographic materials have a speed of at least 200, preferably of at least 800, and more preferably of at least 1600, and include a reflective support (described below) having disposed on one side only, one or more photographic silver halide emulsion (hydrophilic colloid) layers and optionally one or more non-light sensitive hydrophilic colloid layer(s). Where there are multiple silver halide emulsion layers, their composition, thickness, and sensitometric properties can be the same or different. Preferably, there is a single silver halide emulsion layer on the reflective support.

In most preferred embodiments, the reflective radiographic materials have a single silver halide emulsion layer on one side of the reflective support and a protective overcoat (described below) over it and any other non-light sensitive layers. Thus, at least one non-light sensitive hydrophilic layer is included with the silver halide emulsion layer. This layer may be an interlayer or overcoat, or both types of non-light sensitive layers can be present.

The silver halide emulsion layer(s) can include silver halide grains having any desirable morphology or comprise a mixture of two or more of such morphologies as long as the desired photographic speed is achieved for the radiographic material. The composition and methods of making such silver halide grains are well known in the art.

Preferably, the one or more silver halide emulsion layers comprise predominantly (more than 50%, and preferably at least 70%, of the total grain projected area) tabular silver halide grains. The grain composition can vary among multiple silver halide emulsion layers, but preferably, the grain composition is essentially the same in all silver halide emulsion layers. These tabular silver halide grains generally comprise at least 50, preferably at least 90, and more preferably at least 95, mol % bromide, based on total silver in the particular emulsion layer. Such emulsions include silver halide grains composed of, for example, silver iodobromide, silver chlorobromide, silver iodochlorobromide, and silver chloroiodobromide. The iodide grain content is generally up to 5 mol %, based on total silver in the emulsion layer. Preferably the iodide grain content is up to 3.5 mol %, and more preferably up to about 1 mol % (based on total silver in the emulsion layer). Mixtures of different tabular silver halide grains can be used in the silver halide emulsion layers.

In some embodiments, especially blue sensitized radiographic materials, the iodide present in the tabular silver halide grains described above is substantially all located in an "internal localized portion" of the grains. This means that substantially none of the iodide is present on the surfaces of the grains. This feature can be defined by the volume % of a grain wherein 0 volume % refers to the center of the grain and 100 volume % represents the grain surface. In the present invention, the iodide is present in an internal localized portion at from about 1.5% to about 90 volume %. Preferably, the "beginning" of the internal localized portion is from about 1.5% to about 10 volume % and the "ending" of the internal localized portion is from about 65% to about 90 volume %. Thus, the nucleated internal portion of the grains contains no iodide. More preferably, the iodide is uniformly distributed throughout the internal localized portion represented by from about 1.7 to about 85 volume %.

This localization of the iodide within the tabular grains can be achieved using known procedures whereby preparation of the tabular grains is begun (nucleation and initial growth) without the presence of iodide. Then iodide is introduced during a predetermined portion of the manufacturing method until the desired volume % includes iodide, and manufacture of the grains is continued without iodide. A representative preparation is provided in the following paragraphs. Other details for making tabular grains in a similar manner are provided in U.S. Pat. No. 4,665,012 (Sugimoto et al.), incorporated herein by reference.

The tabular silver halide grains used in the silver halide emulsion layers generally have as aspect ratio of 15 or more, preferably of 25 or more and up to 45, and more preferably from about 25 to about 40. The aspect ratio can be the same or different in multiple silver halide emulsion layers, but preferably, the aspect ratio is essentially the same in all layers.

In general, the tabular grains have an average grain diameter (ECD) of at least 2.5 μm, and preferably of from about 2.5 to about 4.5 μm. The average grain diameters can be the same or different in multiple silver halide emulsion layers. At least 100 non-overlapping tabular grains are measured to obtain the "average" ECD.

In addition, the tabular grains generally have an average thickness of from about 0.07 to about 0.15 μm and preferably from about 0.07 to about 0.12 μm. The average thickness can be the same or different but preferably it is essentially the same for multiple silver halide emulsion layers.

The procedures and equipment used to determine tabular grain size (and aspect ratio) are well known in the art.

Tabular grain emulsions that have the desired composition and sizes are described in greater detail in the following patents, the disclosures of which are incorporated herein by reference in relation to the tabular grains:

U.S. Pat. No. 4,414,310 (Dickerson), U.S. Pat. No. 4,425,425 (Abbott et al.), U.S. Pat. No. 4,425,426 (Abbott et al.), U.S. Pat. No. 4,439,520 (Kofron et al.), U.S. Pat. No. 4,434,226 (Wilgus et al.), U.S. Pat. No. 4,435,501 (Maskasky), U.S. Pat. No. 4,713,320 (Maskasky), U.S. Pat. No. 4,803,150 (Dickerson et al.), U.S. Pat. No. 4,900,355 (Dickerson et al.), U.S. Pat. No. 4,994,355 (Dickerson et al.), U.S. Pat. No. 4,997,750 (Dickerson et al.), U.S. Pat. No. 5,021,327 (Bunch et al.), U.S. Pat. No. 5,147,771 (Tsaur et al.), U.S. Pat. No. 5,147,772 (Tsaur et al.), U.S. Pat. No. 5,147,773 (Tsaur et al.), U.S. Pat. No. 5,171,659 (Tsaur et al.), U.S. Pat. No. 5,252,442 (Dickerson et al.), U.S. Pat. No. 5,370,977 (Zietlow), U.S. Pat. No. 5,391,469 (Dickerson), U.S. Pat. No. 5,399,470 (Dickerson et al.), U.S. Pat. No. 5,411,853 (Maskasky), U.S. Pat. No. 5,418,125 (Maskasky), U.S. Pat. No. 5,494,789 (Daubendiek et al.), U.S. Pat. No. 5,503,970 (Olm et al.), U.S. Pat. No. 5,536,632 (Wen et al.), U.S. Pat. No. 5,518,872 (King et al.), U.S. Pat. No. 5,567,580 (Fenton et al.), U.S. Pat. No. 5,573,902 (Daubendiek et al.), U.S. Pat. No. 5,576,156 (Dickerson), U.S. Pat. No. 5,576,168 (Daubendiek et al.), U.S. Pat. No. 5,576,171 (Olm et al.), and U.S. Pat. No. 5,582,965 (Deaton et al.).

A variety of silver halide dopants can be used, individually and in combination, in one or more of the silver halide emulsion layers to improve contrast as well as other common sensitometric properties. A summary of conventional dopants is provided in *Research Disclosure*, Item 38957 [Section I Emulsion grains and their preparation, sub-section D, and grain modifying conditions and adjustments are in paragraphs (3), (4), and (5)].

A general summary of silver halide emulsions and their preparation is provided in *Research Disclosure*, Item 38957 (Section I Emulsion grains and their preparation). After precipitation and before chemical sensitization the emulsions can be washed by any convenient conventional technique using techniques disclosed by *Research Disclosure*, Item 38957 (Section III Emulsion washing).

Any of the emulsions can be chemically sensitized by any convenient conventional technique as illustrated by *Research Disclosure*, Item 38957 (Section IV Chemical Sensitization). Sulfur, selenium or gold sensitization (or any combination thereof) is specifically contemplated. Sulfur sensitization is preferred, and can be carried out using for example, thiosulfates, thiosulfonates, thiocyanates, isothiocyanates, thioethers, thioureas, cysteine, or rhodanine. A combination of gold and sulfur sensitization is most preferred.

In addition, if desired, any of the silver halide emulsions can include one or more suitable spectral sensitizing dyes that include, for example, cyanine and merocyanine spectral sensitizing dyes. The useful amounts of such dyes are well known in the art but are generally within the range of from about 200 to about 1000 mg/mole of silver (alternatively, from about 0.2 to about 2 mmol/mole of silver) in the given emulsion layer. It is preferred that all of the silver halide grains used in the present invention (in all silver halide emulsion layers) be "green-sensitized" (spectrally sensitized to radiation of from about 470 to about 570 nm of the electromagnetic spectrum) or "blue-sensitized" (spectrally sensitized to radiation of from about 400 to about 530 nm). Various spectral sensitizing dyes are known for achieving this property. Green-sensitive tabular silver halide grains are most preferred.

It is desirable that the tabular silver halide grains used in the blue-sensitive reflective radiographic materials be spectrally sensitized using a combination of two different classes of spectral sensitizing dyes. Each of the first and second spectral sensitizing dyes has a J-aggregate absorption within the range of from about 380 to about 500 nm (preferably from about 410 to about 490 nm) when absorbed on the tabular silver halide grains. The two dyes typically have different maximum absorption and thus, one is generally "lower" than the other dye. This "lower" dye is termed herein the "first" spectral sensitizing dye and has a maximum J-aggregate absorption of from about 20 to about 50 nm lower than the maximum J-aggregate absorption of the second ("higher") spectral sensitizing dye.

Multiple spectral sensitizing dyes of each type can be used if desired. Thus, two or more first spectral sensitizing dyes can be used with one or more second spectral sensitizing dyes, and the converse is also true. Preferably, only one of each type of spectral sensitizing dye is used in the present invention.

The molar ratio of the first spectral sensitizing dye to the second spectral sensitizing dye is from about 0.25:1 to about 1:1, and preferably it is from about 0.3:1 to about 0.8:1. The most preferred molar ratio is from about 0.4:1 to about 0.7:1. In addition, the combination of spectral sensitizing dyes is present in the silver halide emulsion containing the tabular silver halide grains in an amount sufficient to provide from about 50 to 100% (preferably from about 70 to about 80%) of saturation coverage of the tabular silver halide grains. For most of the useful blue-light sensitive spectral sensitizing dyes, this would amount to from about 400 to about 800 mg/mole, or from about 0.55 to about 1.1 mmol/mole, of total silver in the silver halide emulsion layer. The particular amount will vary with the surface area of the tabular grains used in the emulsion. Optimum amounts will vary with the particular dyes used and a skilled worker in the art would understand how to achieve optimal results with the combination of dyes in appropriate amounts. Obviously, the spectral sensitizing dyes may also be absorbed to any silver halide grains that are not tabular in morphology.

In general, the first spectral sensitizing dye is an anionic benzimidazole-benzoxazole simple cyanine having at least one sulfo or carboxy group in the molecule, and the second spectral sensitizing dye is an anionic benzothiazole—benzothiazole simple cyanine having at least one sulfo or carboxy group in the molecule. Preferably, each of the first and second spectral sensitizing dyes has at least two sulfo groups in the molecule.

More particularly, the first spectral sensitizing dye is a monomethine cyanine dye represented by the following Structure I:

(I)

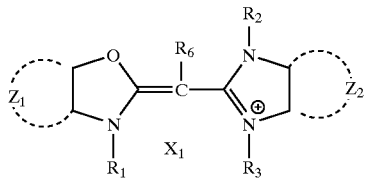

wherein $Z_1$ and $Z_2$ represent the carbon atoms necessary to form a substituted or unsubstituted benzene or naphthalene ring. Thus, the terms "benzothiazole", "benzoxazole", and "benzimidazole" used herein to define the spectral sensitizing dyes are intended to include compounds where $Z_1$ and $Z_2$ form naphthalene rings fused to the defined N-containing heterocyclic rings. Preferably, each of $Z_1$ and $Z_2$ independently represent the carbon atoms necessary to form a substituted or unsubstituted benzene ring.

In Structure I, $R_1$, $R_2$, and $R_3$ are independently alkyl groups having 1 to 10 carbon atoms, alkoxy groups having 1 to 10 carbon atoms, aryl groups having 6 to 10 carbon atoms in the aromatic ring, alkenyl groups having 2 to 8 carbon atoms, and other substituents that would be readily apparent to one skilled in the art. Such groups can be substituted with one or more hydroxy, alkyl, carbonamido, carboxy, sulfo, halo, and alkoxy groups. Preferably, at least one of the $R_1$, $R_2$, and $R_3$ groups comprises at least one sulfo or carboxy group.

More preferably, $R_1$, $R_2$, and $R_3$ are independently alkyl groups having 1 to 4 carbon atoms, phenyl groups, alkoxy groups having 1 to 4 carbon atoms, or alkenyl groups having 2 to 4 carbon atoms. All of these groups can be substituted as described above, and in particular, they can be substituted with a sulfo group.

$R_6$ is hydrogen, a substituted or unsubstituted alkyl group having 1 to 4 carbon atoms, or a phenyl group, each of which groups can be substituted as described above for the other radicals. Preferably, $R_6$ is hydrogen, or a methyl or ethyl group.

In Structure I, $X_1$ is a suitable anion or cation, as needed, to balance the charge of the dye molecule. Useful anions include, but are not limited to, halides, thiocyanate, sulfate, perchlorate, p-toluene sulfonate, ethyl sulfate, and other anions readily apparent to one skilled in the art. Suitable cations include, but are not limited to, alkali metal ions.

Particularly useful second spectral sensitizing dyes are monomethine cyanine dyes represented by the following Structure (II):

(II)

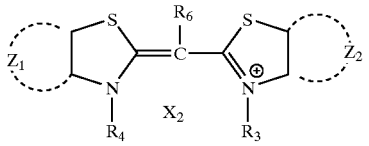

wherein $Z_1$ and $Z_2$ represent the carbon atoms necessary to form a substituted or unsubstituted benzene or naphthalene ring (as defined above for Structure I) and $R_4$ and $R_5$ are independently substituted or unsubstituted alkyl, alkoxy, aryl, or alkenyl groups as defined above for $R_1$ through $R_3$. $R_6$ is as defined above for Structure I. $X_2$ is a suitable anion or cation as defined above for $X_1$.

Preferably, $R_4$ and $R_5$ are independently alkyl groups having 1 to 4 carbon atoms, phenyl groups, alkoxy groups having 1 to 4 carbon atoms, or alkenyl groups having 2 to 4 carbon atoms.

Representative first spectral sensitizing dyes include the following Dyes I-1 through I-7, and representative second spectral sensitizing dyes include the following Dyes II-1 through II-10. A combination of Dyes I-1 and II-1 is most preferred.

(I-1)

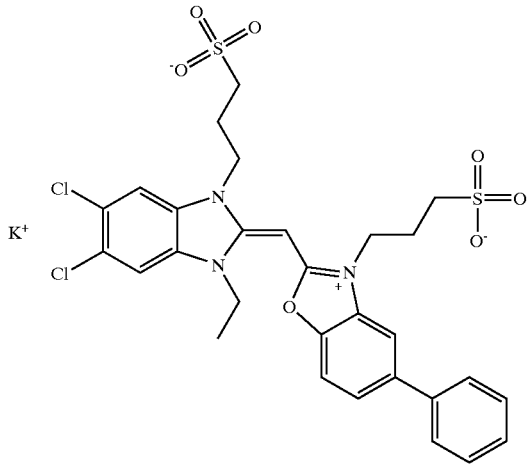

(I-2)

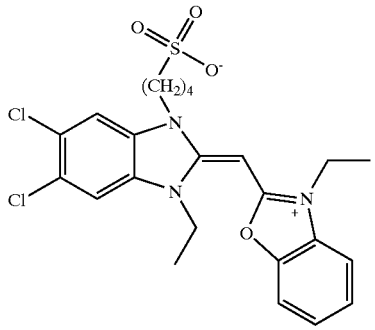

(I-3)

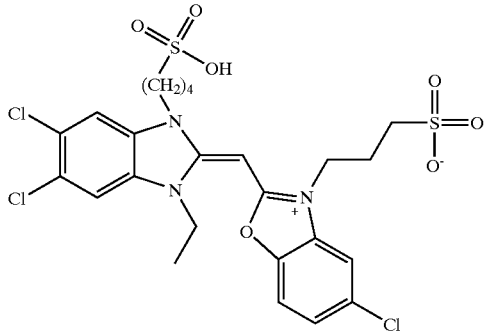

(I-4)

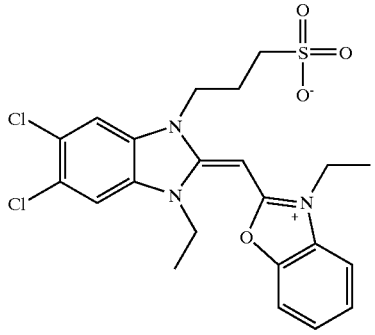

-continued
(I-5)
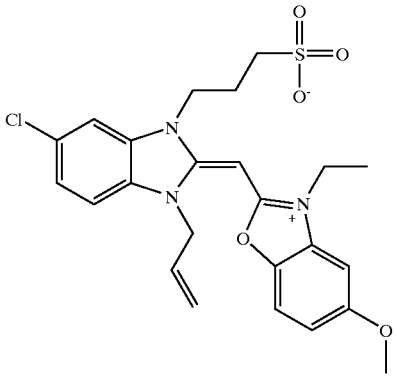
(I-6)
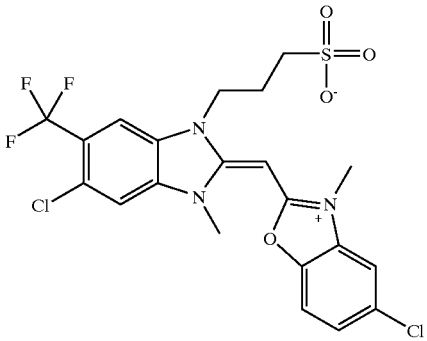
(I-7)
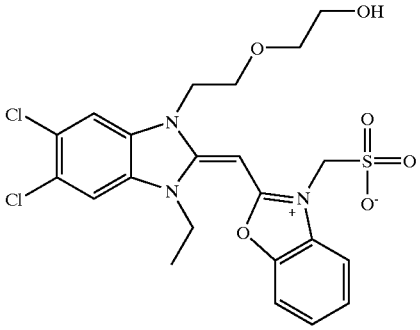
(II-1)
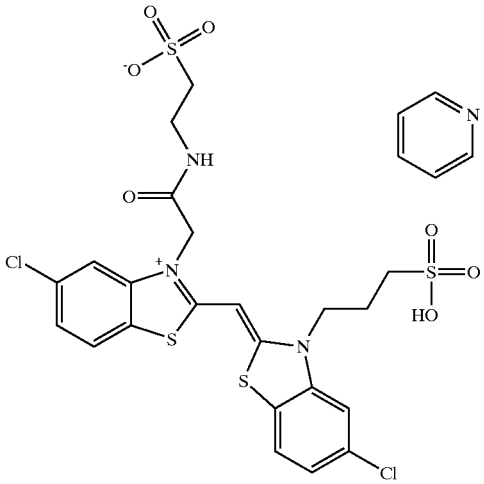
-continued
(II-2)
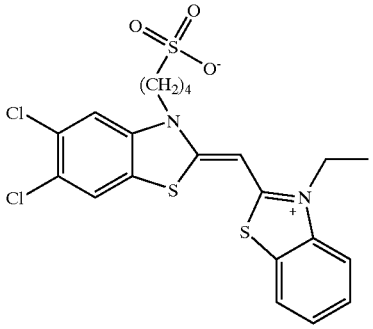
(II-3)
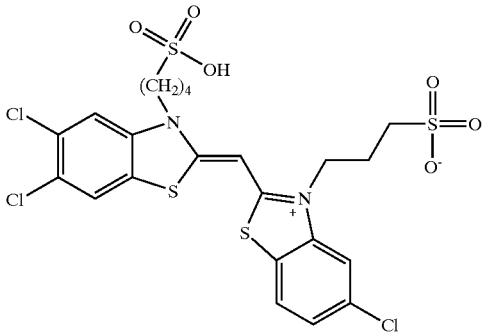
(II-4)
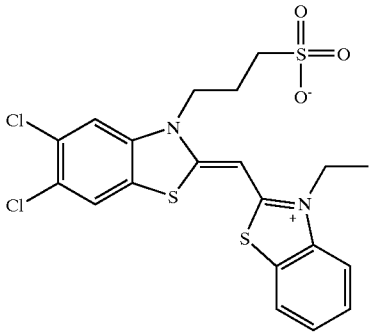
(II-5)
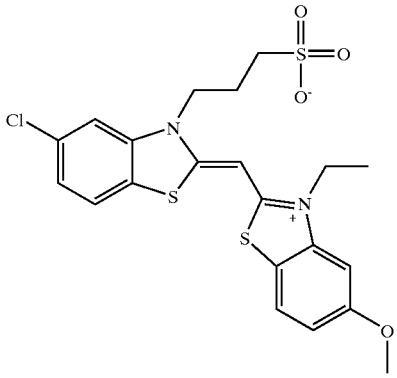

-continued (II-6)

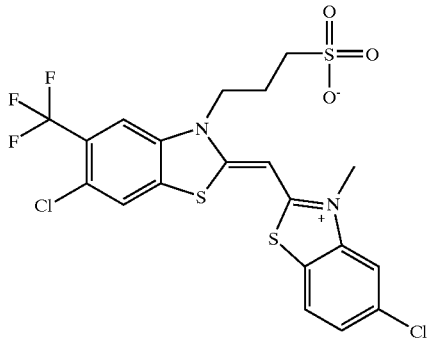

(II-7)

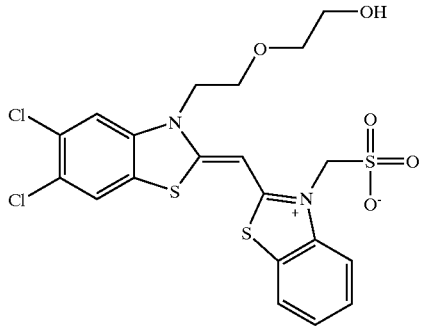

(II-8)

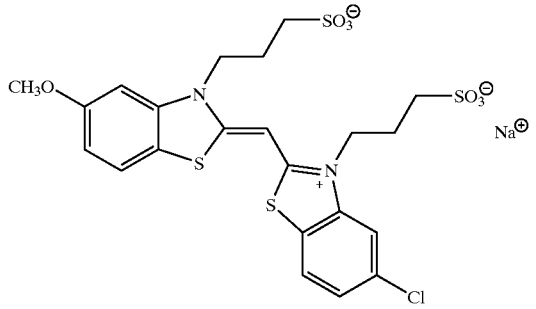

(II-9)

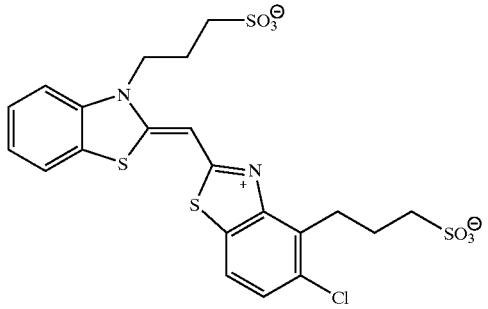

-continued (II-10)

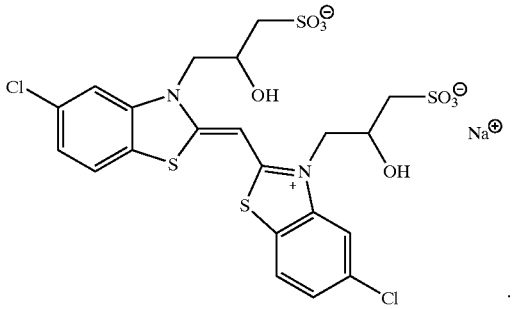

The spectral sensitizing dyes described herein can be prepared as described in U.S. Pat. No. 4,518,689 (Noguchi et al.) or by using known starting materials and synthetic procedures. Other details about such compounds are provided by Hamer, *The Cyanine Dyes and Related Compounds*, Interscience, New York, 1964.

In still other embodiments, a silver halide emulsion layer comprises a blend of tabular silver halide grains, and the blend comprises:

blue-sensitive tabular silver halide grains that have an aspect ratio of at least 15 (preferably from about 20 to about 40), a grain thickness of at least 0.1 μm (preferably from about 0.1 to about 0.15 μm) and comprise at least 90 mol % of bromide (preferably at least 95 mol % bromide) and up to 4 mol % iodide (preferably up to 2 mol % iodide), based on total silver halide, and the iodide may be present in an internal localized portion of the silver halide grains (preferably from about 1.5 to about 90 volume %, with 100 volume % representing the grain surface), and green-sensitive tabular silver halide grains that have an aspect ratio of at least 25 (preferably from about 25 to about 40), a grain thickness of at least 0.07 μm (preferably from about 0.07 to about 0.12 μm), and comprise at least 90 mol % of bromide (preferably up to 95 mol % bromide), up to 1.5 mol % chloride (preferably from about 0.5 to about 1.5 mol % chloride), and up to 1.5 mol % iodide (preferably up to 0.5 mol % iodide), based on total silver halide, wherein the molar ratio of silver in the blue-sensitive tabular silver halide grains to the silver in the green-sensitive tabular silver halide grains is from about 2:1 to about 6:1 (preferably from about 3:1 to about 5:1).

Useful green and blue spectral sensitizing dyes useful for providing this blend of tabular grains are described above.

Instability that increases minimum density in negative-type emulsion coatings (that is fog) can be protected against by incorporation of stabilizers, antifoggants, antikinking agents, latent-image stabilizers and similar addenda in the emulsion and contiguous layers prior to coating. Such addenda are illustrated in *Research Disclosure*, Item 38957 (Section VII Antifoggants and stabilizers) and Item 18431 (Section II Emulsion Stabilizers, Antifoggants and Antikinking Agents).

The radiographic materials of this invention can also include, in the silver halide emulsion layers containing the tabular grains, one more heterocyclic mercaptans such as mercapto-substituted benzothiazoles, mercapto-substituted benzoxazoles, and mercapto-substituted benzimidazoles. Preferably, these heterocyclic mercaptans include a mercapto group (=S or =SH) attached to a carbon atom in the ring that is adjacent a nitrogen atom in the ring.

The heterocyclic rings of these compounds can be further substituted as would be appreciated by one skilled in the art from the teaching in several patents including U.S. Pat. No. 4,013,470 (Landon, Jr.) that is incorporated herein by reference. Useful substituents include, but are not limited to, substituted or unsubstituted alkyl groups having 1 to 10 carbon atoms, substituted or unsubstituted aryl groups having 6 to 10 carbon atoms in the carbocyclic aromatic ring, hydroxy groups, substituted or unsubstituted alkoxy or aryloxy groups having up to 10 carbon atoms, amino groups, heterocyclyl groups having 5 to 10 atoms in the heterocyclic ring, and additional mercapto groups.

Preferred heterocyclic mercaptans include unsubstituted 2-mercapto-1,3-benzothiazole, unsubstituted 2-mercapto-1,3-benzoxazole, and unsubstituted 2-mercapto-1,3-benzimidazole. The most preferred compound is unsubstituted 2-mercapto-1,3-benzothiazole.

The heterocyclic mercaptans described herein are generally present in the silver halide emulsion layer containing the tabular grains described above in an amount of from about 0.3 to about 1 mmole per mole of total silver, and preferably at from about 0.5 to about 0.8 mmole per mole of total silver, in that emulsion layer. These compounds are readily prepared using known starting materials and reaction methods.

It may also be desirable that the silver halide emulsion layers include one or more covering power enhancing compounds adsorbed to surfaces of the silver halide grains. A number of such materials are known in the art, but preferred covering power enhancing compounds contain at least one divalent sulfur atom that can take the form of a —S— or =S moiety. Such compounds are described in U.S. Pat. No. 5,800,976 (Dickerson et al.) that is incorporated herein by reference for the teaching of such sulfur-containing covering power enhancing compounds.

The silver halide emulsion layers and other hydrophilic layers on the reflective support of the radiographic materials generally contain conventional polymer vehicles (peptizers and binders) that include both synthetically prepared and naturally occurring colloids or polymers. The most preferred polymer vehicles include gelatin or gelatin derivatives alone or in combination with other vehicles. Conventional gelatino-vehicles and related layer features are disclosed in *Research Disclosure*, Item 38957 (Section II Vehicles, vehicle extenders, vehicle-like addenda and vehicle related addenda). The emulsions themselves can contain peptizers of the type set out in Section II, paragraph A (Gelatin and hydrophilic colloid peptizers). The hydrophilic colloid peptizers are also useful as binders and hence are commonly present in much higher concentrations than required to perform the peptizing function alone. The preferred gelatin vehicles include alkali-treated gelatin, acid-treated gelatin or gelatin derivatives (such as acetylated gelatin, deionized gelatin, oxidized gelatin and phthalated gelatin). Cationic starch used as a peptizer for tabular grains is described in U.S. Pat. No. 5,620,840 (Maskasky) and U.S. Pat. No. 5,667,955 (Maskasky). Both hydrophobic and hydrophilic synthetic polymeric vehicles can be used also. Such materials include, but are not limited to, polyacrylates (including polymethacrylates), polystyrenes, polyacrylamides (including polymethacrylamides), and dextrans as described in U.S. Pat. No. 5,876,913 (Dickerson et al.), incorporated herein by reference.

Thin, high aspect ratio tabular grain silver halide emulsions useful in the present invention will typically be prepared by processes including nucleation and subsequent growth steps. During nucleation, silver and halide salt solutions are combined to precipitate a population of silver halide nuclei in a reaction vessel. Double jet (addition of silver and halide salt solutions simultaneously) and single jet (addition of one salt solution, such as a silver salt solution, to a vessel already containing an excess of the other salt) process are known. During the subsequent growth step, silver and halide salt solutions, and/or preformed fine silver halide grains, are added to the nuclei in the reaction vessel, and the added silver and halide combines with the existing population of grain nuclei to form larger grains. Control of conditions for formation of high aspect ratio tabular grain silver bromide and iodobromide emulsions is known, for example, based upon U.S. Pat. No. 4,434,226 (Wilgus et al.), U.S. Pat. No. 4,433,048 (Solberg et al.), and U.S. Pat. No. 4,439,520 (Kofron et al.). It is recognized, for example, that the bromide ion concentration in solution at the stage of grain formation must be maintained within limits to achieve the desired tabularity of grains. As grain growth continues, the bromide ion concentration in solution becomes progressively less influential on the grain shape ultimately achieved. For example, U.S. Pat. No. 4,434,226 (Wilgus et al.), for example, teaches the precipitation of high aspect ratio tabular grain silver bromoiodide emulsions at bromide ion concentrations in the pBr range of from 0.6 to 1.6 during grain nucleation, with the pBr range being expanded to 0.6 to 2.2 during subsequent grain growth. U.S. Pat. No. 4,439,520 (Kofron et al.) extends these teachings to the precipitation of high aspect ratio tabular grain silver bromide emulsions. pBr is defined as the negative log of the solution bromide ion concentration. U.S. Pat. No. 4,414,310 (Daubendiek et al.) describes a process for the preparation of high aspect ratio silver bromoiodide emulsions under pBr conditions not exceeding the value of 1.64 during grain nucleation. U.S. Pat. No. 4,713,320 (Maskasky), in the preparation of high aspect ratio silver halide emulsions, teaches that the useful pBr range during nucleation can be extended to a value of 2.4 when the precipitation of the tabular silver bromide or bromoiodide grains occurs in the presence of gelatino-peptizer containing less than 30 micromoles of methionine (for example, oxidized gelatin) per gram. The use of such oxidized gel also enables the preparation of thinner and/or larger diameter grains, and/or more uniform grain populations containing fewer non-tabular grains.

The use of oxidized gelatin as peptizer during nucleation, such as taught by U.S. Pat. No. 4,713,320 (noted above), is particularly preferred for making thin, high aspect ratio tabular grain emulsions for use in the present invention, employing either double or single jet nucleation processes. As gelatin employed as peptizer during nucleation typically will comprise only a fraction of the total gelatin employed in an emulsion, the percentage of oxidized gelatin in the resulting emulsion may be relatively small, that is, at least 0.05% (based on total dry weight).

Thus it is preferred that the coated tabular grain silver halide emulsion layers comprise tabular silver halide grains dispersed in a hydrophilic polymeric vehicle mixture comprising at least 0.05% and preferably at least 0.1% of oxidized gelatin based on the total dry weight of hydrophilic polymeric vehicle mixture in the coated emulsion layer. The upper limit for the oxidized gelatin is not critical but for practical purposes, it is 1.5% based on the total dry weight of the hydrophilic polymer vehicle mixture. Preferably, from about 0.1 to about 1.5% (by dry weight) of the hydrophilic polymer vehicle mixture is oxidized gelatin.

It is also preferred that the oxidized gelatin be in the form of deionized oxidized gelatin but non-deionized oxidized gelatin can be used, or a mixture of deionized and non-deionized oxidized gelatins can be used. Deionized or non-deionized oxidized gelatin generally has the property of relatively lower, amounts of methionine per gram of gelatin than other forms of gelatin. Preferably, the amount of methionine is from 0 to about 30 □mol of methionine, and more preferably from 0 to 10 □mol of methionine, per gram of gelatin. This material can be prepared using known procedures.

The remainder of the polymeric vehicle mixture can be any of the hydrophilic vehicles described above, but preferably it is composed of alkali-treated gelatin, acid-treated gelatin acetylated gelatin, or phthalated gelatin.

The silver halide emulsions containing the tabular silver halide grains described above can be prepared as noted using a considerable amount of oxidized gelatin (preferably deionized oxidized gelatin) during grain nucleation and growth, and then additional polymeric binder can be added to provide the coating formulation. The amounts of oxidized gelatin in the emulsion can be as low as 0.3 g per mole of silver and as high as 27 g per mole of silver in the emulsion. Preferably, the amount of oxidized gelatin in the emulsion is from about 1 to about 20 g per mole of silver.

The silver halide emulsion layers (and other hydrophilic layers) in the reflective radiographic materials are generally fully hardened using one or more conventional hardeners. Thus, the amount of hardener on the one side of the support is generally at least 1% and preferably at least 1.5%, based on the total dry weight of the polymer vehicles.

The levels of silver and polymer vehicle in the reflective radiographic material can vary in the various silver halide emulsion layers. In general, the total amount of silver on the imaging side of the reflective support is at least 13 and no more than 18 mg/dm$^2$ (preferably from about 15 to about 18 mg/dm$^2$). In addition, the total coverage of polymer vehicle (all layers) on the imaging side of the reflective support is generally at least 36 and no more than 40 mg/dm$^2$ (preferably from about 38 to about 40 mg/dm$^2$). These amounts refer to dry weights.

The reflective radiographic materials generally include a surface protective overcoat disposed on the imaging side that typically provides for physical protection of the various layers underneath. The protective overcoat can be sub-divided into two or more individual layers. For example, protective overcoats can be sub-divided into surface overcoats and interlayers (between the overcoat and silver halide emulsion layers). In addition to vehicle features discussed above the protective overcoats can contain various addenda to modify the physical properties of the overcoats. Such addenda are described in *Research Disclosure*, Item 38957 (Section IX Coating physical property modifying addenda, A. Coating aids, B. Plasticizers and lubricants, C. Antistats, and D. Matting agents). Interlayers that are typically thin hydrophilic colloid layers can be used to provide a separation between the silver halide emulsion layers and the surface overcoats or between the silver halide emulsion layers. The overcoat can also include a blue toning dye or a tetraazaindene (such as 4-hydroxy-6-methyl-1,3,3a, 7-tetraazaindene) if desired.

The protective overcoat is generally comprised of one or more hydrophilic colloid vehicles, chosen from among the same types disclosed above in connection with the emulsion layers.

The various coated layers of radiographic materials can also contain tinting dyes to modify the image tone to reflected light. These dyes are not decolorized during processing and may be homogeneously or heterogeneously dispersed in the various layers. Preferably, such non-bleachable tinting dyes are in one or more silver halide emulsion layers.

In some embodiments, the reflective radiographic materials contain one or more "incorporated black-and-white developing agents" (or reducing agents) that are compounds that can act to reduce silver (I) ion to silver metal. Conventional black-and-white developing agents of this type include aminophenols, polyhydroxybenzenes (such as p-dihydroxybenezenes including hydroquinone and its derivatives), ascorbic acid and its derivatives (see for example U.S. Pat. No. 5,236,816 (Purol et al.) and U.S. Pat. No. 5,738,979 (Fitterman et al.), both incorporated by reference), 3-pyrazolidinones, and phenylenediamines. Hydroquinone and its derivatives are preferred black-and-white developing agents. Mixtures of black-and-white developing agents can be used if desired.

The quantity of black-and-white developing agent in the reflective radiographic material depends upon the silver content of silver halide emulsion layer in which it is located and the reducing agent "strength" of the developing agent. It can be located in the single silver halide emulsion layer, or in one or more of multiple silver halide emulsion layers. Generally, the molar ratio of developer to silver is at least 0.25:1 and preferably it is from about 0.5:1 to about 2:1.

It may also be useful to include one or more "co-developers" in one or more silver halide emulsion layers that may work in association with the black-and-white developing agent to enhance the development process. The co-developer is usually present in a smaller quantity than the black-and-white developing agent with a molar ratio of black-and-white developing agent to co-developer being from about 10:1 to about 300:1, and preferably from about 175:1 to about 250:1.

Useful co-developers include aminophenols [such as p-aminophenol, o-aminophenol, N-methylaminophenyl, 2,4-diaminophenol hydrochloride, N-(4-hydroxyphenyl) glycine, and ELON® (methyl-p-aminophenol sulfate)], 1-phenyl-3-pyrazolidones or phenidones [such as compounds described in U.S. Pat. No. 5,236,816 (noted above) including phenidone-A (1-phenyl-3-pyrazolidone), phenidone-B (1-phenyl-4,4'-dimethyl-3-pyrazolidone), dimezone-S (1-phenyl-4-methyl-4'-hydroxymethyl-3-pyrazolidone)], blocked phenidones, and many other compounds known in the art. A most preferred co-developer is 1-phenyl-4-methyl-4'-hydroxymethyl-3-pyrazolidone.

The black-and-white developing agent and co-developers can be incorporated into the silver halide layer(s) or into an adjacent non-photosensitive layer using procedures known in the art.

Reflective Support

The radiographic materials have a reflective support. By "reflective", we mean a support having a composition or structural arrangement such that it reflects at least 70% of incident light (such as light emitted from a fluorescent intensifying screen). Preferably, at least 80% of incident light is reflected by the support.

Various reflective supports can be used including those used for conventional photographic papers that comprise wood fibers or a cellulosic material that is generally coated with baryta or one or more resins or polymers (such as polyolefins). Either or both the coating or paper can contain various reflective pigments such as titanium dioxide, barium sulfate, zinc sulfate, and others known in the photographic color paper art, antioxidants, optical brighteners and fluorescent materials. Further details about reflective paper supports are provided in *Research Disclosure*, September 1996, Item 38957, paragraph XV and references cited therein. Polyethylene resin-coated photographic papers containing titanium dioxide pigments are the preferred reflective supports for this invention.

Reflective lenticular supports as described in U.S. Pat. No. 5,013,621 (Kistner et al.) and U.S. Pat. No. 5,075,204 (Shiba et al.) can also be used.

Pigmented polymer supports can also be used including pigmented polyesters, pigmented polystyrene, and pigmented polycarbonates.

In addition, a reflective support can be a single- or multi-layer reflective sheet that is a reflective substrate comprising a "microvoided" continuous polyester first phase and a second phase dispersed within the continuous polyester first phase. This second phase comprises microvoids containing barium sulfate particles.

The continuous polyester first phase of the reflective substrate provides a matrix for the other components of the reflective substrate and is transparent to longer wavelength electromagnetic radiation. This polyester phase can comprise a film or sheet of one or more thermoplastic polyesters, which film has been biaxially stretched (that is, stretched in both the longitudinal and transverse directions) to create the microvoids therein around the barium sulfate particles. Any suitable polyester can be used as long as it can be cast, spun, molded, or otherwise formed into a film or sheet, and can be biaxially oriented as noted above. Generally, the polyesters have a glass transition temperature of from about 50 to about 150° C. (preferably from about 60 to about 100° C.) as determined using a differential scanning calorimeter (DSC). Suitable polyesters include those produced from the reaction of aromatic, aliphatic, or carbocyclic dicarboxylic acids of 4 to 20 carbon atoms and aliphatic or aromatic glycols having 2 to 24 carbon atoms.

Suitable polyesters that can be used in the practice of this invention include, but are not limited to, poly(1,4-cyclohexylene dimethylene terephthalate), poly(ethylene terephthalate), poly(ethylene naphthalate), and poly(1,3-cyclohexylene dimethylene terephthalate). Poly(1,4-cyclohexylene dimethylene terephthalate) is most preferred.

The ratio of the refractive index of the continuous polyester first phase to the second phase is from about 1.4:1 to about 1.6:1.

Barium sulfate particles are incorporated into the continuous polyester phase. These particles generally have an average particle size of from about 0.3 to about 2 $\mu$m (preferably from about 0.7 to about 1.0 $\mu$m). In addition, these particles comprise from about 35 to about 65 weight % (preferably from about 55 to about 60 weight %) of the total dry reflective substrate weight, and from about 15 to about 25% of the total reflective substrate volume.

The barium sulfate particles can be incorporated into the continuous polyester phase by various means. For example, they can be incorporated during polymerization of the dicarboxylic acid(s) and polyol(s) used to make the continuous polyester first phase. Alternatively and preferably, the barium sulfate particles are mixed into pellets of the polyester and the mixture is extruded to produce a melt stream that is cooled into the desired sheet containing barium sulfate particles dispersed therein.

These barium sulfate particles are at least partially bordered by voids because they are embedded in the microvoids distributed throughout the continuous polyester first phase. Thus, the microvoids containing the barium sulfate particles comprise a second phase dispersed within the continuous polyester first phase. The microvoids generally occupy from about 35 to about 60% (by volume) of the dry reflective substrate.

The microvoids can be of any particular shape, that is circular, elliptical, convex, or any other shape reflecting the film orientation process and the shape and size of the barium sulfate particles. The size and ultimate physical properties of the microvoids depend upon the degree and balance of the orientation, temperature and rate of stretching, crystallization characteristics of the polyester, the size and distribution of the barium sulfate particles, and other considerations that would be apparent to one skilled in the art. Generally, the microvoids are formed when the extruded sheet containing barium sulfate particles is biaxially stretched using conventional orientation techniques.

Further details about such "microvoided" supports are provided in copending and commonly assigned U.S. Ser. No. 10/968,483 (filed Oct. 19, 2004 by Laney and Steklenski).

Still other reflective supports can be similarly prepared using a "microvoided" poly(lactic acid) instead of a "microvoided" polyester as described in U.S. Pat. No. 6,836,606 (Laney et al.).

The reflective support can have a thickness (dry) of from about 150 to about 190 $\mu$m (preferably from about 170 to about 190 $\mu$M).

Imaging Assemblies

A radiographic imaging assembly is composed of one reflective radiographic material as described herein and one fluorescent intensifying screen arranged on the imaging side of the reflective radiographic material. The imaging assembly has a cumulative system speed of at least 200 (preferably at least 1600 and more preferably at least 3200) for the entire "system". The reflective radiographic material and fluorescent intensifying screen can be arranged in a suitable "cassette" designed for this purpose. Fluorescent intensifying screens are typically designed to absorb X-rays and to promptly emit electromagnetic radiation having a wavelength greater than 300 nm. These screens can take any convenient form providing they meet all of the usual requirements for use in radiographic imaging. Examples of conventional, useful fluorescent intensifying screens and methods of making them are provided in *Research Disclosure*, Item 18431 (Section IX X-Ray Screens/Phosphors) and U.S. Pat. No. 5,021,327 (Bunch et al.), U.S. Pat. No. 4,994,355 (Dickerson et al.), U.S. Pat. No. 4,997,750 (Dickerson et al.), and U.S. Pat. No. 5,108,881 (Dickerson et al.), the disclosures of which are here incorporated by reference. The fluorescent layer contains prompt-emitting phosphor particles dispersed in a suitable binder, and may also include a light scattering material, such as titania.

Any prompt-emitting phosphor can be used, singly or in mixtures, in the intensifying screens. The phosphors can be either blue-light or green-light emitting phosphors but the green-light emitting phosphors are preferred for most embodiments of this invention. For example, useful phosphors are described in numerous references relating to fluorescent intensifying screens, including but not limited to, *Research Disclosure*, Vol. 184, August 1979, Item 18431 (Section IX X-ray Screens/Phosphors) and U.S. Pat. No. 2,303,942 (Wynd et al.), U.S. Pat. No. 3,778,615 (Luckey), U.S. Pat. No. 4,032,471 (Luckey), U.S. Pat. No. 4,225,653 (Brixner et al.), U.S. Pat. No. 3,418,246 (Royce), U.S. Pat.

No. 3,428,247 (Yocon), U.S. Pat. No. 3,725,704 (Buchanan et al.), U.S. Pat. No. 2,725,704 (Swindells), U.S. Pat. No. 3,617,743 (Rabatin), U.S. Pat. No. 3,974,389 (Ferri et al.), U.S. Pat. No. 3,591,516 (Rabatin), U.S. Pat. No. 3,607,770 (Rabatin), U.S. Pat. No. 3,666,676 (Rabatin), U.S. Pat. No. 3,795,814 (Rabatin), U.S. Pat. No. 4,405,691 (Yale), U.S. Pat. No. 4,311,487 (Luckey et al.), U.S. Pat. No. 4,387,141 (Patten), U.S. Pat. No. 4,021,327 (Bunch et al.), U.S. Pat. No. 4,865,944 (Roberts et al.), U.S. Pat. No. 4,994,355 (Dickerson et al.), U.S. Pat. No. 4,997,750 (Dickerson et al.), U.S. Pat. No. 5,064,729 (Zegarski), U.S. Pat. No. 5,108,881 (Dickerson et al.), U.S. Pat. No. 5,250,366 (Nakajima et al.), and U.S. Pat. No. 5,871,892 (Dickerson et al.), and EP 0 491,116A1 (Benzo et al.), the disclosures of all of which are incorporated herein by reference with respect to the phosphors.

The inorganic phosphor can be calcium tungstate, activated or unactivated lithium stannates, niobium and/or rare earth activated or unactivated yttrium, lutetium, or gadolinium tantalates, rare earth (such as terbium, lanthanum, gadolinium, cerium, and lutetium)-activated or unactivated middle chalcogen phosphors such as rare earth oxychalcogenides and oxyhalides, and terbium-activated or unactivated lanthanum and lutetium middle chalcogen phosphors.

Still other useful phosphors are those containing hafnium as described in U.S. Pat. No. 4,988,880 (Bryan et al.), U.S. Pat. No. 4,988,881 (Bryan et al.), U.S. Pat. No. 4,994,205 (Bryan et al.), U.S. Pat. No. 5,095,218 (Bryan et al.), U.S. Pat. No. 5,112,700 (Lambert et al.), U.S. Pat. No. 5,124,072 (Dole et al.), and U.S. Pat. No. 5,336,893 (Smith et al.), the disclosures of which are all incorporated herein by reference.

Alternatively, the inorganic phosphor is a rare earth oxychalcogenide and oxyhalide phosphors and represented by the following formula (1):

$$M'_{(w-n)}M''_nO_wX' \quad (1)$$

wherein M' is at least one of the metals yttrium (Y), lanthanum (La), gadolinium (Gd), or lutetium (Lu), M" is at least one of the rare earth metals, preferably dysprosium (Dy), erbium (Er), europium (Eu), holmium (Ho), neodymium (Nd), praseodymium (Pr), samarium (Sm), tantalum (Ta), terbium (Tb), thulium (Tm), or ytterbium (Yb), X' is a middle chalcogen (S, Se, or Te) or halogen, n is 0.002 to 0.2, and w is 1 when X' is halogen or 2 when X' is a middle chalcogen. These include rare earth-activated lanthanum oxybromides, and terbium-activated or thulium-activated gadolinium oxides or oxysulfides (such as $Gd_2O_2S$:Tb).

Other suitable phosphors are described in U.S. Pat. No. 4,835,397 (Arakawa et al.) and U.S. Pat. No. 5,381,015 (Dooms), both incorporated herein by reference, and include for example divalent europium and other rare earth activated alkaline earth metal halide phosphors and rare earth element activated rare earth oxyhalide phosphors. Of these types of phosphors, the more preferred phosphors include alkaline earth metal fluorohalide prompt emitting phosphors include alkaline earth metal fluorobromoiodide such as barium fluorobromide phosphors.

Another class of useful phosphors includes rare earth hosts such as rare earth activated mixed alkaline earth metal sulfates such as europium-activated barium strontium sulfate.

Other useful phosphors are alkaline earth metal phosphors that can be the products of firing starting materials comprising optional oxide or a combination of species as characterized by the following formula (2):

$$MFX_{1-z}I_zuM^aX^a{:}yA{:}eQ{:}tD \quad (2)$$

wherein "M" is magnesium (Mg), calcium (Ca), strontium (Sr), or barium (Ba), "F" is fluoride, "X" is chloride (Cl) or bromide (Br), "I" is iodide, $M^a$ is sodium (Na), potassium (K), rubidium (Rb), or cesium (Cs), $X^a$ is fluoride (F), chloride (Cl), bromide (Br), or iodide (I), "A" is europium (Eu), cerium (Ce), samarium (Sm), or terbium (Tb), "Q" is BeO, MgO, CaO, SrO, BaO, ZnO, $Al_2O_3$, $La_2O_3$, $In_2O_3$, $SiO_2$, $TiO_2$, $ZrO_2$, $GeO_2$, $SnO_2$, $Nb_2O_5$, $Ta_2O_5$, or $ThO_2$, "D" is vanadium (V), chromium (Cr), manganese (Mn), iron (Fe), cobalt (Co), or nickel (Ni). The numbers in the noted formula are the following: "z" is 0 to 1, "u" is from 0 to 1, "y" is from $1\times10^{-4}$ to 0.1, "e" is form 0 to 1, and "t" is from 0 to 0.01. These definitions apply wherever they are found in this application unless specifically stated to the contrary. It is also contemplated that "M", "X", "A", and "D" represent multiple elements in the groups identified above.

The phosphor can be dispersed in a suitable binder(s) in a phosphor layer. A particularly useful binder is a polyurethane binder such as that commercially available under the trademark Permuthane.

The fluorescent intensifying screens useful in this invention exhibit a photographic "screen" speed of at least 100, preferably of at least 400, and more preferably of at least 600. One preferred phosphor is a terbium activated gadolinium oxysulfide. Preferred blue-light emitting phosphors include calcium tungstate and barium fluorobromide. A skilled worker in the art would be able to choose the appropriate inorganic phosphor, its particle size, emission wavelength, and coverage in the phosphor layer to provide the desired screen speed.

Support materials for fluorescent intensifying screens and storage phosphor panels include cardboard, plastic films such as films of cellulose acetate, polyvinyl chloride, polyvinyl acetate, polyacrylonitrile, polystyrene, polyester, polyethylene terephthalate, polyamide, polyimide, cellulose triacetate and polycarbonate, metal sheets such as aluminum foil and aluminum alloy foil, ordinary papers, baryta paper, resin-coated papers, pigmented papers containing titanium dioxide or the like, and papers sized with polyvinyl alcohol or the like. A flexible plastic film is preferably used as the support material.

In addition, the support can be a "microvoided support" as described in more detail in U.S. Pat. No. 6,836,606 and U.S. Published Patent Application 2005/0098738.

The plastic film may contain a light-absorbing material such as carbon black, or may contain a light-reflecting material such as titanium dioxide or barium sulfate. The former is appropriate for preparing a high-resolution type radiographic screen, while the latter is appropriate for preparing a high-sensitivity screen. It is highly preferred that the support absorbs substantially all of the radiation emitted by the phosphor. Examples of preferred supports include polyethylene terephthalate, blue colored or black colored (for example, LUMIRROR C, type X30 supplied by Toray Industries, Tokyo, Japan). These supports may have a thickness that may differ depending o the material of the support, and may generally be between 60 and 1000 $\mu$g/m, more preferably between 80 and 500 $\mu$m from the standpoint of handling.

Imaging and Processing

Exposure and processing of the reflective radiographic materials can be undertaken in any convenient conventional manner. The exposure and processing techniques of U.S. Pat. Nos. 5,021,327 and 5,576,156 (both noted above) are typical for processing radiographic materials. Exposing X-radiation is generally directed through a patient and then through a fluorescent intensifying screen arranged against the frontside (imaging side) of the radiographic material. The screen then emits suitable radiation in an imagewise fashion to provide the latent image in the reflective radiographic material.

It is advantageous that the imaging assembly comprising the reflective radiographic material and screen has sufficiently high photographic speed that they can be imaged using "low power" and less expensive X-radiation generators. Generally, such X-radiation generators have relatively low, fixed X-radiation tube currents in the range of from about 15 to about 20 milliAmperes (mA) and peak 100–130 kVp voltage, preferably also used combination with an anti-X-ray scatter grid with a grid ratio of 8:1 or higher. In contrast, the typical "fixed installation" high-powered X-radiation generating systems produce 500–1000 mA enabling very short (5–40 milliseconds) patient exposure times for motion-sensitive imaging such as chest radiography.

Processing compositions (both developing and fixing compositions) are described in U.S. Pat. No. 5,738,979 (Fitterman et al.), U.S. Pat. No. 5,866,309 (Fitterman et al.), U.S. Pat. No. 5,871,890 (Fitterman et al.), U.S. Pat. No. 5,935,770 (Fitterman et al.), U.S. Pat. No. 5,942,378 (Fitterman et al.), all incorporated herein by reference. The processing compositions can be supplied as single- or multi-part formulations, and in concentrated form or as more diluted working strength solutions.

Since the reflective radiographic material contains an incorporated black-and-white developing agent (and possibly a co-developer), processing is preferably carried out using simpler processing solutions. For example, the imaged material can be contacted with an activator composition having a pH of at least 10 and at least 0.05 mol/l of sulfite ions, followed by contact with a solution comprising a fixing agent other than a sulfite and no black-and-white developing agent. These two steps can be carried out sequentially, or simultaneously when the activator composition also comprises the fixing agent.

The activator solution generally has a pH of at least 10, preferably at least 11, and more preferably at least 12. The alkalinity of this solution and the presence of sulfite ions "activates" the incorporated black-and-white developing agent in the processed reflective radiographic material. Useful fixing agents include those well known for radiographic film processing. More details concerning the processing of materials containing the incorporated black-and-white developing agent are provided in copending and commonly assigned U.S. Ser. No. 11/091,049 (filed on even date herewith).

Radiographic kits can include an imaging assembly, additional fluorescent intensifying screens and/or metal screens, one or more reflective radiographic materials, and/or one or more suitable processing compositions.

The following examples are presented for illustration and the invention is not to be interpreted as limited thereby.

EXAMPLE 1

Radiographic Material A (Invention):

Radiographic Material A was a reflective radiographic material with a single green-light sensitive silver halide emulsion layer disposed on one side only of a reflective support. The emulsion layer contained tabular silver halide grains that were prepared and dispersed in deionized oxidized gelatin that had been added at multiple times before and/or during the nucleation and early growth of the silver bromide tabular grains dispersed therein. The tabular grains had a mean aspect ratio of about 40. The nucleation and early growth of the tabular grains were performed using a "bromide-ion-concentration free-fall" process in which a dilute silver nitrate solution was slowly added to a bromide ion-rich deionized oxidized gelatin environment. The grains were chemically sensitized with sulfur, gold, and selenium using conventional procedures. Spectral sensitization to about 560 nm was provided using anhydro-5,5-dichloro-9-ethyl-3,3'-bis(3-sulfopropyl)oxacarbocyanine hydroxide (680 mg/mole of silver) followed by potassium iodide (400 mg/mole of silver).

The reflective support was a resin-coated paper support containing a reflective pigment having the desired reflectance for this invention.

Material A had the following layer arrangement and formulations on the reflective support:

Overcoat
Emulsion Layer
Reflective Support

| | Coverage (mg/dm$^2$) |
|---|---|
| Overcoat Formulation | |
| Gelatin vehicle | 10.8 |
| TRITON ® X-200E surfactant | 0.28 |
| Olin 10G surfactant | 0.74 |
| Emulsion Layer Formulation | |
| Tabular grain emulsion [AgBr 4.0 $\mu$m avg. dia. × 0.10 $\mu$m thickness] | 16.1 |
| Oxidized gelatin vehicle | 2.5 |
| Non-oxidized gelatin vehicle | 22.8 |
| 5-Bromo-4-hydroxy-6-methyl-1,3,3a,7-tetraazaindene | 0.03 |
| Hydroquinone | 11.7 |
| 4-methyl-4'-hydroxymethyl-1-phenyl pyrazolidone | 0.1 |
| 2-Propenoic acid, butyl ester, polymer derived from ethenylbenzene, 2-methyl-2-((1-oxo-2-propenyl)amino)-1-propane-sulfonic acid, monosodium salt and 2-methyl-2-propenamide | 10.0 |
| TRITON ® X-200E surfactant | 0.3 |
| Oxiranemethanol, polymer with nonylphenol | 0.9 |
| Bisvinylsulfonylmethane | 3.5% based on total gelatin on imaging side |

Radiographic Material B (Control):

The layer arrangement and reflective support of Material B were like that for Material A and contained the same green-light sensitive emulsion ingredients and overcoat except that hydroquinone and 4-methyl-4'-hydroxymethyl-1-phenyl pyrazolidone were omitted. The emulsion coated on one side of the reflective support contained a "run-iodide MIF ammonia-ripened oxidized gelatin" having silver iodobromide tabular grains dispersed therein (aspect ratio of 30). The iodide was added during grain growth as a 3.5 mol % vAg-controlling iodobromide salt, starting at the beginning of growth (1.7% of silver run) to 85% of the silver run. This provided iodide in a localized portion of the grains of 1.7 to 85% where 100% refers to the grain surface. The remainder of the emulsion grains was comprised of silver bromide.

Radiographic Material C (Invention):

Material C was a reflective radiographic material with a single blue-light sensitive silver halide emulsion layer disposed on one side only of a reflective support (same as for Material A). The emulsion layer contained tabular silver halide grains that were prepared and dispersed in deionized oxidized gelatin that had been added at multiple times before and/or during the nucleation and early growth of the silver bromide tabular grains dispersed therein. The tabular grains had a mean aspect ratio of about 40. The nucleation and early growth of the tabular grains were performed using a "bromide-ion-concentration free-fall" process in which a dilute silver nitrate solution was slowly added to a bromide ion-rich deionized oxidized gelatin environment. The grains were chemically sensitized with aurousdithiosulfate, sodium thiocyanate, and potassium selenocyanate using conventional procedures. Spectral sensitization to the "blue" (420–480 nm) region was provided using a 50:50 molar blend of spectral sensitizing dyes SS-1 and SS-2 identified below. The total amount of spectral sensitizing dyes was 500 mg per mole of silver.

(SS-1)

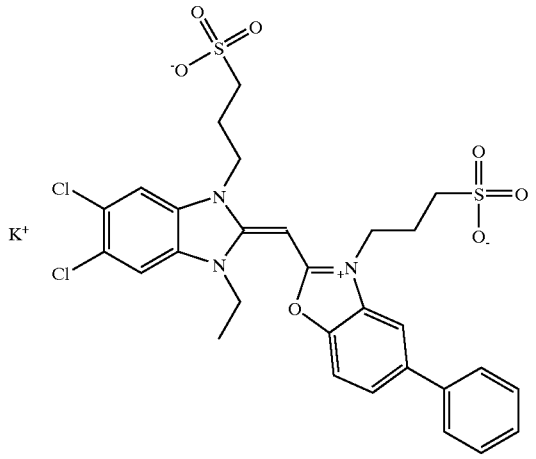

(SS-2)

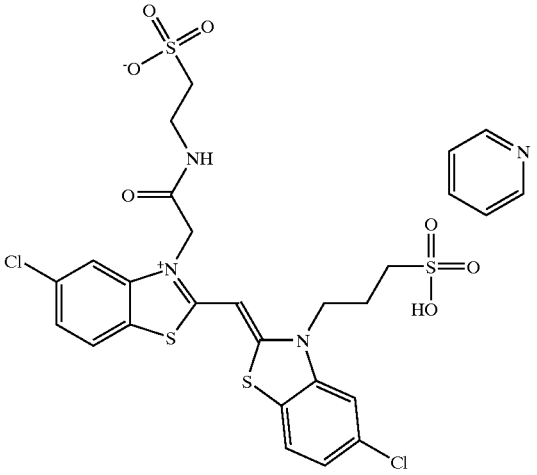

Material C had the following layer arrangement and formulations of the reflective support:

Overcoat

Emulsion Layer

Reflective Support

| | Coverage (mg/dm$^2$) |
|---|---|
| Overcoat Formulation | |
| Gelatin vehicle | 10.8 |
| TRITON ® X-200E surfactant | 0.28 |
| Olin 10G surfactant | 0.74 |
| Emulsion Layer Formulation | |
| Tabular grain emulsion [AgIBr 1.5:98.5 mole halide ratio, 3.0 $\mu$m avg. dia. × 0.12 $\mu$m thickness] | 16.1 |
| Oxidized gelatin vehicle | 2.5 |
| Non-oxidized gelatin vehicle | 22.8 |
| 5-Bromo-4-hydroxy-6-methyl-1,3,3a,7-tetraazaindene | 0.03 |
| Hydroquinone | 11.7 |
| 4-methyl-4'-hydroxymethyl-1-phenyl pyrazolidone | 0.1 |
| TRITON ® X-200E surfactant | 0.3 |
| Oxiranemethanol, polymer with nonylphenol | 0.9 |
| Bisvinylsulfonylmethane | 3.5% based on total gelatin on imaging side |

Reflective Material D (Control):

The layer arrangement and reflective support of Material D were like that for Material C and contained the same blue-light sensitive emulsion ingredients and overcoat except that hydroquinone and 4-methyl-4'-hydroxymethyl-1-phenyl pyrazolidone were omitted.

Reflective Material E (Invention):

Material E was a green-light sensitive reflective radiographic material that had the following layer arrangement and formulations of the reflective support:

Overcoat

Interlayer

Emulsion Layer

Reflective Support

The noted layers were prepared from the following formulations:

| | Coverage (mg/dm$^2$) |
|---|---|
| Overcoat Formulation | |
| Gelatin vehicle | 3.4 |
| Methyl methacrylate matte beads | 0.14 |
| Carboxymethyl casein | 0.57 |
| Colloidal silica (LUDOX AM) | 0.57 |
| Polyacrylamide | 0.57 |
| Chrome alum | 0.025 |
| Resorcinol | 0.058 |
| Spermafol | 0.15 |
| Interlayer Formulation | |
| Gelatin vehicle | 3.4 |
| Carboxymethyl casein | 0.57 |
| Colloidal silica (LUDOX AM) | 0.57 |
| Polyacrylamide | 0.57 |
| Chrome alum | 0.025 |
| Resorcinol | 0.058 |
| Nitron | 0.044 |
| Emulsion Layer Formulation | |
| Tabular grain emulsion [AgBr 2.9 □m avg. dia. × 0.10 □m thickness] | 16.1 |
| Gelatin vehicle | 26.3 |
| 4-Hydroxy-6-methyl-1,3,3a,7-tetraazaindene | 2.1 g/Ag mole |
| Hydroquinone | 11.7 |

-continued

| | Coverage (mg/dm$^2$) |
|---|---|
| 4-methyl-4'-hydroxymethyl-1-phenyl pyrazolidone | 0.1 |
| Potassium nitrate | 1.8 |
| Ammonium hexachloropalladate | 0.0022 |
| Maleic acid hydrazide | 0.0087 |
| Sorbitol | 0.53 |
| Glycerin | 0.57 |
| Potassium bromide | 0.14 |
| Resorcinol | 0.44 |
| Bisvinylsulfonylmethane | 2% based on total gelatin in all layers on each side |

Reflective Material F (Control):

The layer arrangement and reflective support of Material F were like that for Material E and contained the same green-light sensitive emulsion ingredients, interlayer, and overcoat except that hydroquinone and 4-methyl-4'-hydroxymethyl-1-phenyl pyrazolidone were omitted.

Samples of the green-sensitive reflective radiographic materials (A, B, E, and F) were exposed, through a graduated density step tablet, to a 500 watt General Electric DMX projector lamp in a Macbeth sensitometer for $1/50^{th}$ second, calibrated to 2650°K, filtered with a Corning C4010 filter to simulate a green-light emitting phosphor from a green-emitting fluorescent intensifying screen.

Samples of the blue-sensitive reflective radiographic materials (C and D) were exposed by using a Corning filter to simulate a blue-emitting phosphor in a blue-light emitting fluorescent intensifying screen.

The exposed samples of Materials A–F were processed using the two-step Processing Method A and compositions described below.

Processing Method A:

A two-step processing method was carried out using the following processing solutions. The resulting sensitometric data are provided below in TABLE I.

| Activator Solution: | |
|---|---|
| Potassium bromide | 0.017 mol/l |
| Potassium hydroxide | 1.75 mol/l |
| Ethylenediaminetetraacetic acid (EDTA) | 1 g/l |
| Sodium sulfite | 0.156 mol/l |
| pH | >12 |
| Fixing Composition 1: | |
| Ammonium thiosulfate | 1.0 mol/l |
| Sodium thiosulfate | 0.15 mol/l |

-continued

| | |
|---|---|
| Pentetic acid, pentasodium salt | 2 g/l |
| Sodium sulfite | 0.15 mol/l |
| Acetic acid | 0.08 mol/l |
| pH | 4.2 |
| Fixing Composition 2: | |
| Cysteine hydrochloride | 0.3 mol/l |
| Sodium hydroxide | 0.25 mol/l |
| Sodium sulfite | 0.05 mol/l |
| Acetic acid | 0.05 mol/l |
| pH | 6.0 |

A Control two-step method was carried out using the following black-and-white developing and fixing compositions:

| | |
|---|---|
| Hydroquinone | 30 g |
| Phenidone | 1.5 g |
| Potassium hydroxide | 21 g |
| $NaHCO_3$ | 7.5 g |
| $K_2SO_3$ | 44.2 g |
| $Na_2S_2O_5$ | 12.6 g |
| Sodium bromide | 35 g |
| 5-Methylbenzotriazole | 0.06 g |
| Glutaraldehyde | 4.9 g |
| Water to 1 liter, pH | 10 |

Fixing was carried out using KODAK RP X-OMAT®LO Fixer and Replenisher fixing composition (Eastman Kodak Company).

Optical densities are expressed below in terms of diffuse density as measured by a conventional X-rite Model 310TM densitometer that was calibrated to ANSI standard PH 2.19 and was traceable to a National Bureau of Standards calibration step tablet. The characteristic density vs. logE curve was plotted for each radiographic material that was exposed and processed as noted above. System speed was measured as noted above at a density of $1.0+D_{min}$.

TABLE 1

| Radiographic Material | Fixing Comp. 1 $D_{min}$ | Fixing Comp. 1 $D_{max}$ | Fixing Comp. 1 Dynamic Range | Fixing Comp. 2 $D_{min}$ | Fixing Comp. 2 $D_{max}$ | Fixing Comp. 2 Dynamic Range | RP X-OMAT ® Dynamic Range |
|---|---|---|---|---|---|---|---|
| A (Invention) | 0.22 | 1.69 | 1.47 | 0.55 | 1.68 | 1.13 | 1.50 |
| B (Control) | 0.10 | 0.10 | 0 | 0.10 | 0.10 | 0 | 1.39 |
| C (Invention) | 0.25 | 1.65 | 1.40 | 0.31 | 1.67 | 1.36 | 1.41 |
| D (Control) | 0.10 | 0.10 | 0 | 0.11 | 0.11 | 0 | 1.14 |
| E (Invention) | 0.32 | 1.60 | 1.28 | 0.53 | 1.68 | 1.15 | 1.45 |
| F (Control) | 0.10 | 0.10 | 0 | 0.10 | 0.10 | 0 | 1.31 |

The data in TABLE I show that the reflective radiographic materials of the present invention can be processed using an activator solution and Fixing Composition 1 or 2 to provide acceptable $D_{min}$, $D_{max}$, and dynamic range. The dynamic range results were not too different from those obtained using the conventional radiographic film RP X-OMAT® processing chemistry (Controls).

EXAMPLE 2

Samples of the reflective radiographic materials described in Example 1 were also exposed and processed using the following one-step Processing Method B and compositions.

Processing Method B:

One-step processing was carried out using each of the following activator-fixing compositions 1–4 containing a thiosulfate fixing agent:

| | |
|---|---|
| Activator-Fixing Composition 1: | |
| Potassium bromide | 0.012 mol/l |
| Potassium hydroxide | 1.2 mol/l |
| Ethylenediaminetetraacetic acid (EDTA) | 1 g/l |
| Sodium sulfite | 0.09 mol/l |
| Sodium thiosulfate | 0.15 mol/l |
| pH | >13 |
| Activator-Fixing Composition 2: | |
| Potassium bromide | 0.006 mol/l |
| Potassium hydroxide | 0.6 mol/l |
| Ethylenediaminetetraacetic acid (EDTA) | 0.4 g// |
| Sodium sulfite | 0.045 mol/l |
| Sodium thiosulfate | 0.072 mol/l |
| pH | >13 |
| Activator-Fixing Composition 3: | |
| Potassium bromide | 0.003 mol/l |
| Potassium hydroxide | 0.2 mol/l |
| Ethylenediaminetetraacetic acid (EDTA) | 0.022 g/l |
| Sodium sulfite | 0.022 mol/l |
| Sodium thiosulfate | 0.036 mol/l |
| pH | >13 |
| Activator-Fixing Composition 4: | |
| Potassium bromide | 0.0015 mol/l |
| Potassium hydroxide | 0.15 mol/l |
| Ethylenediaminetetraacetic acid (EDTA) | 0.1 g/l |
| Sodium sulfite | 0.011 mol/l |
| Sodium thiosulfate | 0.017 mol/l |
| pH | >13 |

The samples of the reflective radiographic materials A through F were in contact with each activator-fixing composition for about 60 seconds at 20° C. The processed samples were then washed with water at 20° C. for about 30 seconds. No black-and-white developer solutions were used. Thus, there were no separate activation and fixing steps.

The following TABLES II and III show the resulting $D_{min}$, $D_{max}$, and dynamic range data.

These data show reasonable dynamic range results (>1.00) were obtained using the reflective radiographic materials even at lower concentrations of fixing agent (thiosulfate) and lower concentrations of hydroxide. Adequate activation and fixing can be achieved over a wide range of constituent concentrations.

EXAMPLES 3

Samples of the reflective radiographic materials described in Example 1 were also exposed and processed using the one-step Processing Method B and the following activator-fixing compositions containing cysteine as the fixing agent:

| | |
|---|---|
| Activator-Fixing Composition 5: | |
| Potassium bromide | 0.04 mol/l |
| Potassium hydroxide | 1.8 mol/l |
| Ethylenediaminetetraacetic acid (EDTA) | 1 g/l |
| Sodium sulfite | 0.12 mol/l |
| Cysteine | 0.14 mol/l |
| pH | >13 |
| Activator-Fixing Composition 6: | |
| Potassium bromide | 0.02 mol/l |
| Potassium hydroxide | 1.8 mol/l |
| Ethylenediaminetetraacetic acid (EDTA) | 1 g/l |
| Sodium sulfite | 0.12 mol/l |
| Cysteine | 0.12 mol/l |
| pH | >13 |
| Activator-Fixing Composition 7: | |
| Potassium bromide | 0.004 mol/l |
| Potassium hydroxide | 0.35 mol/l |
| Ethylenediaminetetraacetic acid (EDTA) | 0.3 g/l |
| Sodium sulfite | 0.002 mol/l |
| Cysteine | 0.022 mol/l |
| pH | >13 |

Samples of the reflective radiographic materials A through F were exposed as described in Example 2 and processed using each of the "activator-fixing" compositions 5–7 described above. The samples were in contact with each activator-fixing composition for about 60 seconds at 20° C. The processed samples were then washed with water at 20° C. for about 30 seconds. No black-and-white developer solutions were used. Thus, there were no separate activation and fixing steps.

TABLE II

| Radiographic Material | Composition 1 $D_{min}$ | Composition 1 $D_{max}$ | Composition 1 Dynamic Range | Composition 2 $D_{min}$ | Composition 2 $D_{max}$ | Composition 2 Dynamic Range |
|---|---|---|---|---|---|---|
| A (Invention) | 0.23 | 1.42 | 1.19 | 0.22 | 1.53 | 1.31 |
| B (Control) | 0.10 | 0.10 | 0 | 0.10 | 0.10 | 0 |
| C (Invention) | 0.40 | 1.42 | 1.02 | 0.36 | 1.52 | 1.16 |
| D (Control) | 0.11 | 0.11 | 0 | 0.11 | 0.11 | 0 |
| E (Invention) | 0.37 | 1.37 | 1.00 | 0.23 | 1.49 | 1.26 |
| F (Control) | 0.10 | 0.10 | 0 | 0.10 | 0.10 | 0 |

TABLE III

| Radiographic Material | Composition 3 $D_{min}$ | Composition 3 $D_{max}$ | Composition 3 Dynamic Range | Composition 4 $D_{min}$ | Composition 4 $D_{max}$ | Composition 4 Dynamic Range |
|---|---|---|---|---|---|---|
| A (Invention) | 0.22 | 1.60 | 1.38 | 0.31 | 1.59 | 1.28 |
| B (Control) | 0.10 | 0.10 | 0 | 0.10 | 0.10 | 0 |
| C (Invention) | 0.36 | 1.44 | 1.08 | 0.36 | 1.29 | 0.93 |
| D (Control) | 0.10 | 0.10 | 0 | 0.10 | 0.10 | 0 |
| E (Invention) | 0.23 | 1.46 | 1.23 | 0.27 | 1.24 | 0.97 |
| F (Control) | 0.10 | 0.10 | 0 | 0.10 | 0.10 | 0 |

The following TABLE IV shows the resulting $D_{min}$, $D_{max}$, and dynamic range data.

TABLE IV

| Radiographic Material | Composition 5 $D_{min}$ | Composition 5 $D_{max}$ | Composition 5 Dynamic Range | Composition 6 $D_{min}$ | Composition 6 $D_{max}$ | Composition 6 Dynamic Range | Composition 7 $D_{min}$ | Composition 7 $D_{max}$ | Composition 7 Dynamic Range |
|---|---|---|---|---|---|---|---|---|---|
| A (Invention) | 0.10 | 1.72 | 1.62 | 0.11 | 1.75 | 1.64 | 0.24 | 1.77 | 1.53 |
| B (Control) | 0.10 | 0.10 | 0 | 0.10 | 0.10 | 0 | 0.10 | 0.10 | 0 |
| C (Invention) | 0.16 | 1.73 | 1.57 | 0.19 | 1.66 | 1.47 | 0.31 | 1.61 | 1.30 |
| D (Control) | 0.10 | 0.10 | 0 | 0.10 | 0.10 | 0 | 0.10 | 0.10 | 0 |
| E (Invention) | 0.11 | 1.68 | 1.57 | 0.23 | 1.68 | 1.45 | 0.27 | 1.65 | 1.38 |
| F (Control) | 0.10 | 0.10 | 0 | 0.10 | 0.10 | 0 | 0.10 | 0.10 | 0 |

The results in TABLE IV show good dynamic range and low $D_{min}$ due to excellent fixing and clearing with cysteine-containing compositions, even at lower concentrations.

EXAMPLE 4

Samples of the reflective radiographic materials A, B, E, and F described in Example 1 were also exposed and processed using the one-step Processing Method B and the following activator-fixing compositions containing thiocyanate or thiosalicylic acid as the fixing agent.

Activator-Fixing Composition 8:

| | |
|---|---|
| Potassium bromide | 0.0017 mol/l |
| Potassium hydroxide | 0.72 mol/l |
| Ethylenediaminetetraacetic acid (EDTA) | 1 g/l |
| Sodium sulfite | 0.10 mol/l |
| Sodium thiocyanate | 0.14 mol/l |
| pH | >13 |

The results from processing are shown in TABLE V below.

Activator-Fixing Composition 9:

| | |
|---|---|
| Potassium bromide | 0.017 mol/l |
| Potassium hydroxide | 0.72 mol/l |
| Ethylenediaminetetraacetic acid (EDTA) | 1 g/l |
| Sodium sulfite | 0.10 mol/l |
| Thiosalicylic acid | 0.14 mol/l |
| pH | >13 |

The results from using this composition are also shown below in TABLE V.

TABLE V

| Radiographic Material | Composition 8 $D_{min}$ | Composition 8 $D_{max}$ | Composition 8 Dynamic Range | Composition 9 $D_{min}$ | Composition 9 $D_{max}$ | Composition 9 Dynamic Range |
|---|---|---|---|---|---|---|
| A (Invention) | 0.41 | 1.57 | 1.16 | 0.55 | 1.58 | 1.03 |
| B (Control) | 0.13 | 0.13 | 0 | 0.13 | 0.13 | 0 |
| E (Invention) | 0.38 | 1.53 | 1.15 | 0.59 | 1.58 | 0.99 |
| F (Control) | 0.14 | 0.14 | 0 | 0.17 | 0.17 | 0 |

The invention has been described in detail with particular reference to certain preferred embodiments thereof, but it will be understood that variations and modifications can be effected within the spirit and scope of the invention.

What is claimed is:

1. A reflective radiographic silver halide material having a speed of at least 200 and comprising a reflective support having first and second major surfaces, said radiographic silver halide material having on said first major surface only, one or more hydrophilic colloid layers including a silver halide emulsion layer comprising predominantly tabular silver halide grains, said tabular grains in said silver halide emulsion layer being dispersed in a hydrophilic polymeric vehicle mixture comprising at least 0.05% of oxidized gelatin, based on the total dry weight of said hydrophilic polymeric vehicle mixture, said material further comprising in at least one layer on said first major surface, a combination of an incorporated black-and-white developing agent and a co-developing agent.

2. The material of claim 1 wherein said support is a reflective resin-coated paper support.

3. The material of claim 1 wherein silver halide grains are predominantly tabular grains that have an aspect ratio of at least 15, an average grain diameter of at least 2.5 μm, an average grain thickness of from about 0.07 to about 0.15 μm, and comprise at least 90 mol % bromide and up to 5 mol % iodide, based on total silver halide.

4. The material of claim 3 wherein substantially all of said iodide is present in an internal localized portion of said tabular silver halide grains and substantially none of the iodide is present on the surface of said grains.

5. The material of claim 3 wherein silver halide grains are predominantly tabular grains that have an aspect ratio of from about 25 to about 45, an average grain diameter of from about 2.5 to about 4.5 μg/m, an average grain thickness of from about 0.07 to about 0.12 μm, and comprise at least 95 mol % bromide and from about 1 to about 3.5 mol % iodide, based on total silver halide.

6. The material of claim 5 wherein substantially all of said iodide is present in an internal localized portion of said tabular silver halide grains that is from about 1.5 to about 90 volume % of said grains wherein 100 volume % represents the surface of said grains.

7. The material of claim 1 wherein said tabular grains are dispersed in a hydrophilic vehicle mixture comprising from about 0.1 to about 1.5% (weight) of oxidized gelatin, based on the total dry weight of said hydrophilic polymeric vehicle mixture.

8. The material of claim 1 having a total silver coverage of at least 13 and less than 18 mg/dm$^2$, and the amount of polymer vehicle on said first major reflective support surface is from about 36 to about 40 mg/dm$^2$.

9. The material of claim 1 wherein said tabular silver halide grains are sensitive to radiation within the range of from about 400 to about 530 nm.

10. The material of claim 1 wherein said black-and-white developing agent is a hydroquinone of derivative thereof.

11. The material of claim 1 wherein said co-developing agent is a 1-phenyl-3-pyrazolidone.

12. The material of claim 1 further comprising a mercapto-substituted benzothiazole, mercapto-substituted benzoxazole, or mercapto-substituted benzimidazole in an amount of at least 0.3 mmole per mole of silver in said material.

13. The material of claim 1 wherein said tabular silver halide grains are spectrally sensitized with a combination of first and second spectral sensitizing dyes that have maximum J-aggregate absorptions on said tabular silver halide grains of from 380 to 500 nm, wherein the maximum J-aggregate absorption of said first spectral sensitizing dye is from 20 to 50 nm lower in wavelength than the maximum J-aggregate absorption of said second spectral sensitizing dye, the molar ratio of said first spectral sensitizing dye to said second spectral sensitizing dye being from 0.25:1 to 1:1, and said first and second spectral sensitizing dyes being present to provide from 50 to 100% of saturation coverage of said tabular silver halide grains.

14. The material of claim 13 wherein said first spectral sensitizing dye is an anionic benzimidazole-benzoxazole simple cyanine having at least one sulfo or carboxy group in the molecule, and said second spectral sensitizing dye is an anionic benzothiazole—benzothiazole simple cyanine having at least one sulfo or carboxy group in the molecule.

15. The material of claim 14 wherein said first spectral sensitizing dye is a monomethine cyanine dye represented by the following Structure I:

(I)

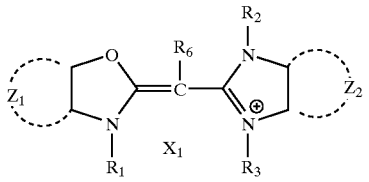

wherein $Z_1$ and $Z_2$ represent the carbon atoms necessary to form a substituted or unsubstituted benzene or naphthalene ring, $R_1$, $R_2$, and $R_3$ are independently substituted or unsubstituted alkyl, alkoxy, aryl, or alkenyl groups, $R_6$ is hydrogen or a substituted or unsubstituted alkyl or phenyl groups, $X_1$ is an anion or cation as needed, provided that Structure I also comprises at least one sulfo or carboxy group, and said second spectral sensitizing dye is a monomethine cyanine dye represented by the following Structure (II):

(II)

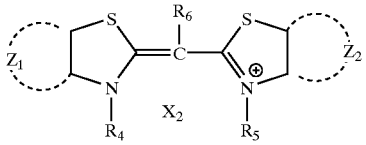

wherein $Z_1$ and $Z_2$ represent the carbon atoms necessary to form a substituted or unsubstituted benzene or naphthalene ring, $R_4$ and $R_5$ are independently substituted or unsubstituted alkyl, alkoxy, aryl, or alkenyl groups, $R_6$ is hydrogen or a substituted or unsubstituted alkyl or phenyl group, $X_2$ is an anion or cation as needed, and provided that Structure II also comprises at least one sulfo or carboxy group.

16. The material of claim 1 wherein said silver halide emulsion layer comprises a blend of tabular silver halide grains, said blend comprising:

blue-sensitive tabular silver halide grains that have an aspect ratio of at least 15, a grain thickness of at least 0.1 $\mu$m and comprise at least 90 mol % of bromide and up to 4 mol % iodide, based on total silver halide, and green-sensitive tabular silver halide grains that have an aspect ratio of at least 25, a grain thickness of at least 0.07 $\mu$m, and comprise at least 90 mol % of bromide, up to 1.5 mol % chloride, and up to 1.5 mol % iodide, based on total silver halide, wherein the molar ratio of silver in said blue-sensitive tabular silver halide grains to the silver in said green-sensitive tabular silver halide grains is from about 2:1 to about 6:1.

17. A radiographic imaging assembly that has a system speed of at least 200 and comprises:

A) a radiographic material of claim 1, and

B) a fluorescent intensifying screen arranged on the imaging side of said radiographic material, said screen having a screen speed of at least 100 and comprising an inorganic phosphor capable of absorbing X-radiation and emitting electromagnetic radiation having a wavelength greater than 300 nm, said inorganic phosphor being coated in admixture with a polymeric binder in a phosphor layer onto a support.

18. A method of providing a black-and-white image comprising processing an exposed reflective radiographic material of claim 1 to provide a black-and-white image.

19. The method of claim 18 further comprising using said black-and-white image for medical diagnosis.

20. The method of claim 18 wherein an image is obtained in said reflective radiographic material using less than a 130 kVp power source of X-radiation.

* * * * *